United States Patent [19]

Brandon et al.

[11] Patent Number: 4,512,849

[45] **Date of Patent: * Apr. 23, 1985**

[54] WET-LAID, NON-WOVEN FABRICS

[75] Inventors: Ralph E. Brandon, Monroe; Charles J. Davis, Goshen; Michael Ring, Warwick; Roy S. Swenson, Central Valley, all of N.Y.

[73] Assignee: International Paper Company, New York, N.Y.

[ * ] Notice: The portion of the term of this patent subsequent to Apr. 29, 1997 has been disclaimed.

[21] Appl. No.: 618,325

[22] Filed: Jun. 8, 1984

Related U.S. Application Data

[63] Continuation of Ser. No. 89,611, Oct. 29, 1979, abandoned, which is a continuation of Ser. No. 786,590, Apr. 11, 1977, Pat. No. 4,200,488, which is a continuation of Ser. No. 551,399, Feb. 20, 1975, Pat. No. 4,049,491.

[51] Int. Cl.[3] ..... D21H 5/12

[52] U.S. Cl. ..... 162/157.2; 162/146; 428/288

[58] Field of Search ..... 162/101, 157.2, 157.6, 162/146, 100, 190, 189, 168.1, 168.2, 168.3, 202, 183, 289, 264; 428/288, 338, 401; 137/4, 92

[56] References Cited

U.S. PATENT DOCUMENTS 3,794,557 2/1974 Harmon ..... 162/157.2

FOREIGN PATENT DOCUMENTS 787649 6/1968 Canada ..... 162/157.2

*Primary Examiner*—Peter Chin

[57] ABSTRACT

An improved process for forming a non-woven fabric by wet-laying, on paper making equipment, staple length, synthetic fibers having a length to diameter ratio of about 400 to 3000, and an improved, non-woven fabric produced by the process. The process involves forming a stable, viscous, uniform, air-fiber-water dispersion by: adding the fibers to a high-shear agitated mixture of water and a dispersant to separate the fibers and to completely and uniformly distribute the individual fibers throughout the resulting, high-shear agitated, air, water and fiber mixture; and then, slowly adding a thixotropic thickener to the high-shear agitated mixture to form the viscous, air-fiber-water dispersion, having a nascent viscosity of about 10 to 125 cps., when measured at a shear rate of 30.5 sec.$^{-1}$, and in which the individual fibers are restrained from becoming entangled and from forming knits, bundles, and strings.

11 Claims, 4 Drawing Figures

WET-LAID, NON-WOVEN FABRICS

This is a continuation of application Ser. No. 89,611, filed Oct. 29, 1979, entitled WET-LAID, NON-WOVEN FABRICS now abandoned, which is a continuation of Ser. No. 786,590, filed Apr. 11, 1977 (now U.S. Pat. No. 4,200,488), which is a continuation of Ser. No. 551,399, filed Feb. 20, 1975 (now U.S. Pat. No. 4,049,491).

BACKGROUND OF THE INVENTION

This invention relates to an improvement in forming wet-laid, non-woven fabrics from aqueous, fiber dispersions. This invention is particularly related to the formation of a stable, viscous, uniform, aqueous dispersion in which the individual fibers do not become entangled. This invention is quite particularly concerned with forming non-woven fabrics from relatively long and thin, flexible, synthetic, staple fibers, such as polyester fibers of $\frac{1}{2}$ to $1\frac{1}{2}$ inches in length and 1.25 to 3.0 denier.

Various processes for forming non-woven fabrics by wet-laying synthetic fibers on paper making equipment are known in the art. Typically, in such processes, the fibers are laid on a forming wire or wire screen as either an aqueous dispersion or as an aqueous foam. See, for example, U.S. Pat. No. 3,808,095 and U.S. Pat. No. 3,839,142.

In all of the heretofore available processes for wet-laying a non-woven fabric, no substantial difficulties have been encountered in utilizing relatively thick and short, inflexible fibers, such as 1.5 denier by $\frac{1}{4}$ inch fibers, 6.0 denier by $\frac{3}{4}$ inch fibers, and 15.0 denier by $1\frac{1}{8}$ inches fibers. However, such processes have been unsatisfactory for forming non-woven fabrics from relatively long and thin, flexible synthetic fibers, such as 1.5 denier by 1 inch fibers and 3.0 denier by $1\frac{1}{2}$ inches fibers. The relatively long and thin, flexible, synthetic fibers have tended to become entangled when suspended in the aqueous dispersions or foams used for wet-laying the fibers on the forming wire. Such fibers, when entangled, have formed knits, bundles and strings in the resulting, non-woven fabrics. The presence of such knits, bundles and strings, in general, has rendered such fabrics commercially unacceptable.

Means have been sought therefore for uniformly dispersing long, thin, flexible, synthetic fibers so that the fibers cannot become entangled. Certain foam dispersions of the fibers have been useful for this purpose. See, for example, British Pat. No. 1,129,757, Canadian Pat. No. 787,649, and U.S. Pat. Nos. 3,716,449, 3,837,999 and 3,007,840. However, the use of foam dispersions has been somewhat limited. This is because such foams are rather difficult and expensive to handle and because the resulting fabrics have tended to be weak and, for this reason, rather difficult to handle. Thus, the use of liquid phase dispersions of fibers has been preferred.

However, severe difficulties have been encountered in the use of liquid phase, i.e., aqueous, dispersions of long, thin, flexible, synthetic fibers, particularly hydrophobic fibers.

Relatively long and thin, flexible, synthetic, staple length fibers generally have been very difficult to disperse in water. The resulting dispersions also have been hard to maintain and to transport to the forming wire as uniform dispersions. However, unless these fibers have been completely dispersed in the liquid medium and maintained in a completely dispersed condition, undesirable entangling and flocculating of the fibers, to produce knits, bundles and strings of the fibers, have occurred to a substantial extent.

These flexible fibers also have been especially prone to flocculate and to thereby form knits and bundles when being dispersed in water. The fibers have tended to bend, twist and curl and to touch other nearby fibers in the aqueous medium, particularly when the aqueous medium has been agitated or subjected to turbulence. When the fibers have been free to bend or touch other fibers, the inevitable result has been the formation of knits, bundles and other undesirable fiber entanglements, such as strings, in the resulting aqueous dispersions and in the resulting non-woven fabrics. This problem has been particularly aggravated with crimped fibers, the crimps of which act as entangling hooks and which readily produce, as a result, knits and long strings.

Further, the resulting dispersions generally have been hard to uniformly apply to the forming wire. This has been because the aqueous media utilized in the dispersions have tended to drain through the forming wire too quickly. In fact, the drainage rate from the aqueous dispersions has been so high that it had not been possible to use shake mechanisms, such as are common in the making of paper, for distributing the fibers more uniformly in the resulting webs.

Thus, means have been sought for expeditiously providing a uniform, water dispersion of flexible fibers, which is stable during periods of storage and of transport to the forming wire and which is adapted to provide a uniform fiber distribution when applied to the forming wire.

One means for promoting the dispersion of the flexible fibers in water and for maintaining the fiber dispersions has involved treating the fibers and/or the water with one or more chemical agents which promote the wetting of each fiber with water. With hydrophilic, synthetic fibers, such as viscose rayon, cellulose acetate and polyvinyl acetate, wetting the fibers has not been much of a problem. Hence, in dispersing such fibers, little or no wetting agent has been required to disperse the fibers. On the other hand, wetting hydrophobic, synthetic fibers made from polymers such as polyamides, polyesters, polyolefins, phenolics and the like has been a more difficult problem since such fibers do not wet easily. Hence, relatively large quantities, e.g., about 0.1% by weight, of a wetting agent have been required in the liquid media to disperse such fibers.

However, since most wetting agents or dispersants are also good foam generating agents, particularly when present in amounts adequate to substantially wet hydrophobic fibers, the use of dispersants often has tended to create copious quantities of unwanted, surface foam, even under gentle agitation conditions. The surface foam produced has tended to float the fibers out of the dispersion. When defoaming agents have been added to dispersions of fibers, the fibers have tended to flocculate, thereby making the formation of a uniform web more difficult.

The use of dispersants which are not good foam generating agents also has been tried. See, for example, U.S. Pat. No. 3,067,087 and Canadian Pat. No. 921,210. With intense agitation and using such dispersants, relatively long and thin, flexible, synthetic fibers have been dispersed in water. However, the use of such dispersants has not in any way diminished the tendency of flexible fibers to become entangled when agitated in liquid media for more than a brief period or the tendency of such fibers to floccuate when removed from the region of high shear agitation, e.g., when being transported to the forming wire. Nor have such dispersants improved the drainage characteristics of the aqueous dispersions on the forming wire. Thus, the use of dispersing agents alone has not completely solved the problems associated with forming and wet-laying liquid phase dispersions of relatively long and thin, flexible, synthetic fibers.

In dispersing fibers, it has been observed that, when the viscosity of the liquid media is increased, fiber flocculation is reduced. For this reason, either with or without the use of dispersants, adding thickeners, such as natural and synthetic gums, to fiber and water mixtures has been tried. The use of thickeners for raising the viscosity of the water has been found useful for forming and maintaining dispersions of fibers. See, for example, Canadian Pat. No. 949,791 and U.S. Pat. Nos. 2,810,644, 3,013,936, 3,098,786, 3,794,557, 3,808,095 and 3,834,983. The use of thickeners also has been found to modify the drainage characteristics of water and fiber dispersions on the forming wire. See, in this regard, U.S. Pat. No. 3,391,057. However, even with such thickeners, dispersing relatively long and thin, flexible, synthetic fibers in liquid media, such as water, and maintaining the fibers in a dispersion, without forming knits, bundles and strings of the fibers, has continued to be a problem.

Another significant difficulty in forming non-woven fabrics from liquid phase dispersions has been in providing fabric webs which can be removed from the forming wire without tearing them or pulling them apart.

To increase the initial, wet web strength, in some instances, hydrated (fibrillated) wood or other natural fibers and/or fibrillated, synthetic fibers have been combined with non-fibrillated, synthetic fiber furnishes. Such combinations have tended to hold non-woven webs together while they have been transferred from a moving, forming wire, across unsupported draws, to wet presses or other treating equipment, where a binder has been added to hold the fibers together more permanently. In such webs, before the addition of any adhesive, the webs have been held together, in part, by the mechanical interlocking of the fibrillated fibers. However, the use of the fibrillated, natural or synthetic fibers as part of the furnish has not proven satisfactory for non-wovens intended for use as replacement fabrics for textiles. This has been because of the stiff, "papery" hand imparted by these fibrillated fibers to the resulting, non-woven fabrics.

Another technique for increasing the initial, wet web strength of non-fibrillated fibers has included coating or encapsulating the fibers with latex polymer binders. These binders have held the sheets together and allowed their continuous removal from the forming wire without their breaking or tearing. However, the use of latex polymer coatings, though providing fabrics of softer and more textile-like properties, has tended to be rather expensive. Such coatings have had the added disadvantage of being tacky, thus making it difficult to maintain clean and non-tacky machine conditions.

Still another technique for holding the wet webs together has involved the very careful control of the amount of water in the web as it is transferred from the forming wire. See, in this regard, U.S. Pat. No. 3,223,581. One disadvantage of such a process has been that its usefulness has been limited to fibers having essentially smooth, flat surfaces for providing large, area surface contact among the fibers forming the sheet. Round and other fibers having no flat surfaces have not worked with this technique. In addition, such fibers have produced relatively dense, stiff and "papery" sheets which are undesirable in non-wovens intended for textile uses.

SUMMARY OF THE INVENTION

In accordance with this invention, a stable, viscous, uniform, air, fiber and water dispersion is provided for a process for forming non-woven fabrics by wet-laying staple length, synthetic fibers, having a length to diameter ratio of about 400 to 3000, on paper making equipment, the steps for forming the viscous dispersion comprising:

adding the fibers to a high-shear agitated mixture of water and a dispersant, to separate the fibers and to completely and uniformly distribute them throughout the resulting, agitated, air, fiber and water mixture; and then, slowly adding a thixotropic thickener to the high-shear agitated mixture to form the viscous, air-fiber-water dispersion;

the viscous dispersion having a nascent viscosity of about 10 to 125 cps., when measured at a shear rate of 30.5 sec.$^{-1}$, and the individual fibers in the viscous dispersion being restrained from becoming entangled and from forming knits, bundles and strings.

By this process, a viscous dispersion is expeditiously provided which can be diluted and uniformly laid on a forming wire to form a non-woven fabric, free of knits, bundles and strings. The resulting, non-woven, fabric web also can be easily removed from the forming wire, without tearing or pulling apart the web.

In accordance with another aspect of this invention, a novel, uniform, non-woven fabric is provided, which comprises at least 50% by weight of staple length, synthetic, hydrophobic fibers having a length to diameter ratio of about 1000 to 3000 and a length of at least ½ inch: which has a microvariation in basic weight of not more than about 10% and a macrovariation in basis weight of not more than about 5%; and which is essentially free of knits, bundles and strings.

DETAILED DESCRIPTION OF THE INVENTION

Figure 1:
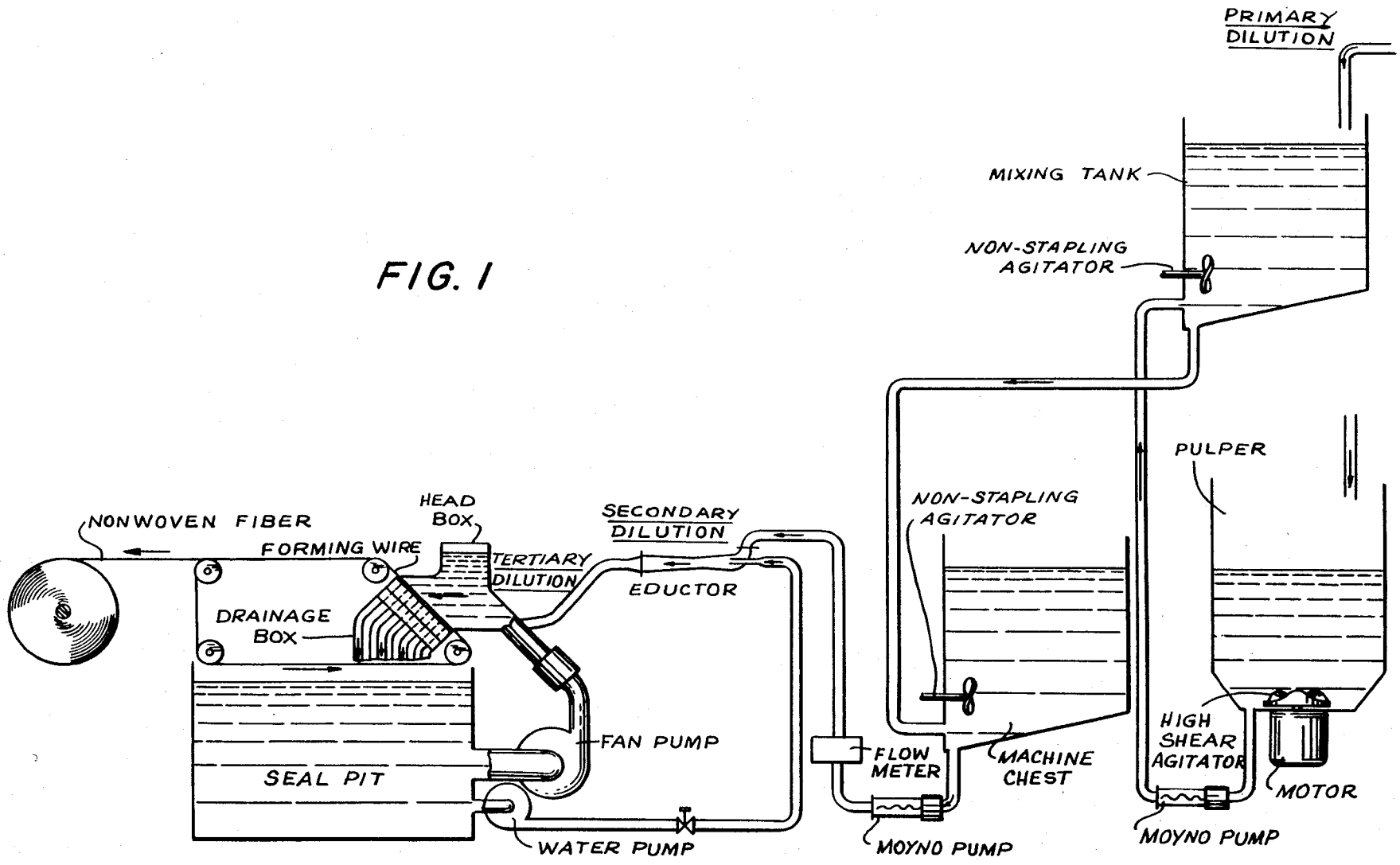
FIG. 1 is a schematic flow chart of the process of this invention.

This invention relates to a process for providing a stable, viscous, uniform, air, fiber and water dispersion, which can be diluted and uniformly laid on a forming wire, such as Fourdrinier wire screen, to provide a non-woven fabric, free of knits, bundles and strings.

According to this invention, any conventional, staple fiber or fibers can be utilized to form the non-woven fabric. Among the staple fibers that can be utilized are the fibrillated and the non-fibrillated fibers and the synthetic and the natural fibers. Thus, by way of example, fiber materials which can be used are the fibers generally disclosed in Canadian Pat. No. 787,649, pages 2 to 4, in U.S. Pat. No. 3,391,057, column 5, lines 4 to 44, in U.S. Pat. No. 3,808,095, column 5, lines 3 to 62, in U.S. Pat. No. 3,837,999, column 6, lines 45 to 53 and in U.S. Pat. No. 3,067,087, column 2, lines 26 to 61. The process of this invention is particularly useful for synthetic, hydrophobic fibers, as for example the polyesters, which are otherwise exceedingly difficult to disperse in water and to uniformly wet-lay on a forming wire.

In accordance with this invention, the dimensions of the staple fibers are not critical, and any conventional fibers can be utilized, such as the fibers of $\frac{1}{8}$ inch or longer and of 1.23 denier or heavier. The process of this invention is useful for fiber furnishes containing at least about 70% by weight of any relatively long and thin, flexible fibers having a length to diameter ratio of about 400 to 3000, such as polyester fibers of 6 denier by $\frac{1}{2}$ inch, of 1.25 denier by $\frac{3}{4}$ inch, and 1.5 denier by $1\frac{1}{2}$ inches. With fiber furnishes containing fibers having a length to diameter ratio of about 700 to 2000, such as polyester fibers of 3 denier by $\frac{1}{2}$ inch and of 1.5 denier by 1 inch, particularly fibers having a length to diameter ratio of about 1500, such as polyester fibers of 1.5 denier by $\frac{3}{4}$ inch, the process of this invention is especially useful.

In the viscous, air-fiber-water dispersion of this invention, mixtures and blends of various staple fibers and of various fiber lengths and weights can be suitably utilized. For this purpose, mixtures of two or more synthetic fibers and mixtures of synthetic fibers and natural fibers can be used. For example, the process of this invention is useful for mixtures containing hydrophobic, synthetic, non-fibrillated fibers and up to 60% fibrillated, natural fibers, e.g., natural wood fibers.

The viscous dispersion of this invention is particularly useful for fiber furnishes containing predominantly (i.e., at least 50% by weight, particularly at least 90% by weight) or exclusively (i.e., 100%), relatively long and thin, flexible, synthetic, hydrophobic fibers. Surprisingly, the relatively long and thin, flexible, synthetic, hydrophobic fibers in such fiber furnishes do not become entangled and hence do no flocculate to form knits, bundles or strings when dispersed in the viscous, air, fiber and water mixture of this invention.

The viscous, air-fiber-water dispersion of this invention is provided by initially adding the fibers to a high-shear agitated mixture of water and a dispersant. In the first step of the process of this invention, the particular amounts of water, dispersant, and fiber utilized are not critical. In this first step, from about 0.1% to 3% by weight of staple length fibers can be suitably utilized. Preferably, for a fiber furnish containing predominantly or exclusively fibers having a length to diameter ratio of about 400 to 700, 2% to 3%, especially about 2.5%, by weight of fibers is utilized; for a fiber furnish containing predominantly or exclusively fibers having a length to diameter ratio of about 700 to 2000, 1% to 2%, especially about 1.5%, by weight of fibers is utilized; and for a fiber furnish containing predominantly or exclusively fibers having a length to diameter ratio of about 2000 to 3000, 0.25% to 1%, especially about 0.5%, by weight of fibers is used. Also in this first step, as little as about 0.0001% by weight of a dispersant can be suitably utilized. Preferably, about 0.001% to 0.2%, especially 0.005% to 0.1%, by weight of a dispersant is used.

The dispersant must be dissolved in the water before the fibers are added. The dispersant and water mixture is agitated vigorously enough to create tumbling surface conditions with little or no vortex. As a result of the agitation, air is entrained in the water in the form of tiny air bubbles. Preferably, the dispersant-water mixture is agitated without creating any substantial amount of surface foam. Then, the fibers are added.

In this first step of the process, any conventional dispersant can be utilized which: (1) is compatible with the fibers utilized; (2) can wet out the individual fibers so that molecules of water can get between and separate the fibers to be added to the dispersant-water mixture; and (3) can reduce the surface tension of the water to a point where tiny air bubbles can be entrained in the water by vigorously agitating the water with a high-shear action. Among the dispersants which can be utilized are the dispersing agents which, when agitated, do not foam substantially, i.e., the non-foaming or no-foam generating dispersants. By way of example, such non-foaming dispersants are the polyacrylic acids and the relatively low molecular weight polyacrylates generally disclosed in British Pat. No. 945,307, page 1, lines 58 to 67, and in Canadian Pat. No. 787,649, page 5, lines 1 to 6. Other non-foaming dispersants which can be used are the relatively low molecular weight polyacrylamides and the acidified (to a pH of about 3 to 4), relatively high molecular weight polyacrylamides and polyacrylates. Also among the dispersants which can be utilized are the relatively low-foam and relatively high-foam generating dispersants, such as are generally disclosed in U.S. Pat. No. 3,007,840, column 5, lines 36 to 47, in U.S. Pat. No. 3,837,999, column 6, lines 53 to 64 and in U.S. Pat. No. 3,067,087, column 4, lines 4 to 31.

Among the non-foaming dispersants, preferred for dispersing hydrophobic, non-fibrillated, synthetic fibers are: the polyacrylic acid dispersants, such as are available under the trade name Acrysol of Rohm and Haas Corp., Philadelphia, Pa.; and the relatively low molecular weight, polyacrylate dispersants, such as the alkali metal, alkaline earth metal and ammonium polyacrylate dispersants that are available under the trade name Collacral, e.g., Collacral DS-2017, of MASF Corp., Paramus, N.J.

Among the relatively high-foam generating dispersants, preferred are the alkylaryl polyether alcohol types, such as the condensation products of ethylene oxide and an alkylphenol that are available under the trade name Triton, e.g., Triton X-100 and Triton X-114, of Rohm and Haas Corp., Philadelphia, Pa.

Among the preferred, relatively low-foam generating dispersants are the alkyl taurines, such as are available under the trade name Igepon, e.g., Igepon CN-42, of GAF Corp., New York, N.Y.

The types of dispersants utilized (i.e., high-, low- or no-foam generating), the particular dispersant compounds utilized, either alone or in combination, and their amounts can vary from one system to another.

The selection of a dispersant depends, inter alia, on the degree of agitation to be provided to the water-dispersant mixture and the nature of the fibers and their finish in regard to wetting. For example, in dispersing some hydrophobic fibers, having a hydrophilic finish, relatively low levels of agitation can be used. In such a case, high-foam generating dispersants, low-foam generating dispersants, and combinations of the two are preferred. However, for other hydrophobic fibers, the agitation may have to be more vigorous to separate the fibers. In such cases, non-foaming dispersants and combinations containing non-foaming and low-foam generating dispersants are preferred.

The amount of dispersant which should be used also will depend on the level of high-shear agitation used and the nature of the fibers to be dispersed.

The amount of dispersant required also depends upon the nature and level of the surface precoating, if any, which is present on the fibers. Naturally, the precise coating on the fibers must be taken into account in determining the amount of dispersant needed in the dispersant-water mixture. If desired, the fibers can be pretreated in a conventional manner to remove coatings which would unduly interfere with the forming of the air-fiber-water mixture of the first step of the process of this invention. For example, treating fibers coated with a hydrophobic finish with a small amount of acid, e.g., dilute sulfuric acid, removes the finish and thereby promotes the wetting-out of such fibers. Hence, the use of the acid permits the use of lesser amounts of a dispersant.

According to this invention, by first dissolving one or more dispersants in the water, the surface tension of the water is reduced to the point where, by agitating the water vigorously enough to create tumbling, essentially vortex-free, water surface conditions, air is entrained in the water in the form of tiny air bubbles. Then, by adding the fibers to the high-shear agitated mixture of water and the dispersant, an air-fiber-water mixture is produced in which the staple fibers are uniformly and completely distributed or dispersed.

The air-fiber-water mixture formed in the first step of the process of this invention is a milky white emulsion which must be maintained in a steady state (i.e., any air bubbles escaping from the mixture must be replaced by others). If the level of the agitation is allowed to fall, some of the air bubbles float out of the emulsion and carry fibers with them. Where high-foam or low-foam, particularly high-foam, generating dispersants are utilized, it is generally preferred that a small quantity of a natural or synthetic thickener be added to the high-shear agitated, water-dispersant mixture, before the fibers are added. The addition of the thickener tends to stabilize the mixture by slowing down the movement of air bubbles. By slowing the movement of the tiny air bubbles, the level of agitation required to form and maintain the air-fiber-water emulsion of the first step in a steady state is less than it otherwise would be. Making this emulsion easier to maintain also makes it easier to handle.

In the first step of this process, the choice of a thickener is not critical, and any conventional thickener which is compatible with the dispersant-water mixture and with the fibers can be used. Among the thickeners which can be utilized are sucrose, gelatin, cross-linked polyacrylamides or any of the thixotropic thickeners which can be used in the second step of the process of this invention. Preferably, the thickener utilized is a thixotropic thickener of the second step of this process, such as a natural or synthetic, essentially anionic, long chain polymer with a ropey or stringy texture (i.e., with a coiled molecular structure). For example, a natural gum, such as the deacetylated Karaya gums of U.S. Pat. No. 3,098,786, or a synthetic thickener, such as a relatively high molecular weight polyethylene oxide or polyacrylamide, is preferably utilized.

If desired, in the first step of this invention, the small quantity of thickener can be added initially with the dispersant or later, after agitation of the water-dispersant mixture has begun. The amounts of thickener utilized in this step are not critical, and under normal conditions, between about 1 to 10 parts by weight, preferably 2 to 5 parts by weight, of thickener per part by weight of dispersant can be suitably used. If too much thickener is added, in this step, the emulsion is difficult to form and maintain, and if too little is used, excessive amounts of surface foam may be generated.

The precise mechanism by which the fibers are dispersed throughout the air, fiber and water mixture, formed by the first step of this process, is not fully understood. However, it is believed that the fibers initially are wetted-out by molecules of water which come between the fibers and coat their surfaces. The wetted-out fibers are then separated and diffused throughout the aqueous medium by the high-shear agitation used.

The vigorous agitation of the first step also entrains air in the form of tiny bubbles in the mixture, without generating any substantial amount of surface foam. In accordance with this process from about 1% to 4% by volume of air is entrained in the mixture. The use of more than about 4% air is not considered to be of any value in this step. This is because more than 4% air generally results in the formation of excessive amounts of surface foam. The 1% to 4% by volume of tiny air bubbles in the mixture appear to act as buffers which help to keep the individual fibers apart, thereby preventing the fibers from touching. The bubbles also seem to prevent the longer fibers from curling or bending-back upon themselves. As a result, the formation of knits and bundles of fibers is prevented. As long as the mixture is maintained in a relatively steady state, it is believed, the bubbles continue to serve this function.

The high-shear turbulence conditions present in a conventional, paper maker's pulper, which has been provided with vertical wall fins to inhibit and reduce vortexing in the liquid, is generally satisfactory for preparing the air, water and fiber mixtures of the process steps of this invention.

One satisfactory pulper for providing the needed high-shear agitation is a hydropulper with a Volkes rotor, having four vertical tub vanes, which is available from Black-Clawson, Inc., Middletown, Ohio. The tank of the pulper should be provided with three or more, smooth, triangular, vertical wall fins, the apices of which extend radially inward a sufficient distance to inhibit and reducing vortexing in the water when the rotor is turned on. Energy input to the rotor is satisfactory if, for each horsepower of input, there is between about 0.16 and 0.9 pounds of fiber per cubic foot of the air-fiber-water mixture.

Other types of mixing equipment, such as a sloping bottom, stock preparation tank with side entry impeller, also can be used to provide the high-shear agitation. For example, a 1500 gallon capacity, 80 inch diameter, 5 foot deep stock preparation tank, with a 17½ inch diameter, three bladed open impeller, having about a 45° to 60° pitch, with the impeller extending about 22 inches into the tank and the impeller shaft lying about 1.5 feet from the tank's circumferential, bottom edge, can be used when the impeller is adapted to rotate at between about 20 to 718 r.p.m., depending on the level of stock in the tank and the staple fiber being dispersed. However, since mixing equipment of this type generally provides less severe agitation than a pulper, it is considered suitable only for dispersing hydrophilic fibers and readily dispersible hydrophobic fibers.

Bottom and top entry, impeller mixing equipment is not considered satisfactory for this process because it tends to create a vortex in the water.

In the first step of the process of this invention, the fibers are added to the water-dispersant mixture after the tiny air bubbles have been entrained in the mixture by the action of the high-shear agitation. The amount of fibers added usually is the maximum amount that can be dispersed in the aqueous mixture without causing substantial entanglement of fibers. The fibers are added to the water-dispersant mixture in a conventional manner. Then, agitation of the mixture continues until the fibers have been completely and uniformly distributed throughout the mixture, and the air-fiber-water, emulsion mixture of the first step of this process is obtained.

As soon as the fibers are distributed throughout the high-shear agitated mixture of air, water and fibers, containing the dispersant, a thixotropic thickener is slowly added to the mixture as the second step. During the slow addition of the thixotropic thickener, the high-shear agitation of the mixture is continued.

The exact time for beginning to add the thixotropic thickener will vary, depending on the particular fibers, the dispersant, and the high-shear agitation used. For example, with a high-foam or low-foam generating dispersant or with a high-foam generating dispersant modified with either a low-foam generating dispersant or a small amount of a thickener, it is preferred that slow addition of the thixotropic thickener to the high-shear agitated mixture be commenced almost immediately after the fibers have been added. This is because the fibers very rapidly become completely and uniformly distributed in the high-shear agitated mixture containing a high-foam or low-foam dispersant, and after being distributed, the fibers tend to become quickly entangled unless the thickener is added. On the other hand, with a non-foaming dispersant, such as polyacrylic acid or an ammonium, sodium or potassium salt of a relatively low molecular weight polyacrylic acid, it is preferred to wait for a period of time before adding the thixotropic thickener. This is because the complete and uniform distribution of the fibers in a high-shear agitated mixture, containing a non-foaming dispersant, is rather slow.

For particular, high-shear agitation conditions and water-dispersant mixtures, the amount of time before commencing the addition of the thixotropic thickener will depend upon the nature of the fibers. Preferably, the thixotropic thickener is added after the fibers are completely and uniformly distributed in the aqueous mixture and before the fibers begin to tangle and entwine to form knits, bundles and strings. Generally this is about five to fifteen minutes, preferably about ten minutes, after the fibers are added to the high-shear agitated mixture. The waiting time before adding the thixotropic thickener also depends on the efficiency of the mixer, providing the high-shear agitation. It is preferred that the dispersant and high-shear mixing system selected for the first step of this process be such that the thickener is properly added to the air-fiber-water mixture about five to ten minutes after the fibers are added.

In the second step of the process of this invention, any conventional, hydrophilic, thixotropic thickener can be utilized. Among the thickening agents which can be used are the relatively high molecular weight, thickening agents, such as: the polyvinyl alcohol, polyethylene oxide and methyl cellulose, thickening agents of Canadian Pat. No. 787,649; the polyethylene oxide, polyacrylamide and acrylamide-acrylic acid copolymer, thickening agents of U.S. Pat. Nos. 3,808,095 and 3,794,557; and the polyacrylamide, thickening agents of U.S. Pat. No. 3,391,057. As thickening agents, the relatively high molecular weight polyacrylates and neutralized (to a pH of about 7) polyacrylic acids also can be used. Among the preferred thixotropic thickeners of this invention are the relatively high molecular weight polyacrylamides, such as are available under the trade name Separan AP-30 of Dow Chemical Corp., Midland, Mich. and under the trade name Polyhall 295 of Stein, Hall & Co., Inc., 605 Third Avenue, New York, N.Y.

The amount of thixotropic thickener added in the second step to the air-fiber-water mixture is not critical, and any amount which will provide a viscous, air-fiber-water dispersion having a nascent viscosity of about 10 to 125 cps., preferably about 10 to 50 cps., when measured at a shear rate of 30.5 sec.$^{-1}$, at 25° C. can be used. A suitable amount of thixotropic thickener, adequate to give the viscous dispersion a nascent viscosity of 10 to 125 cps., when measured at 30.5 sec.$^{-1}$, also should give the viscous dispersion a nascent viscosity on the order of about 2 to 5 cps. in the high-shear regions of the high-shear mixer utilized. A suitable amount of a thixotropic thickener is, for example, between about 0.01% and 0.1% by weight, preferably 0.03% to 0.07% by weight, of Separan AP-30 polyacrylamide thickener, which provides a nascent viscosity of 10 to 50 cps., at a shear rate of 30.5 sec.$^{-1}$, in the viscous dispersions of this invention.

As used throughout this application, the term "nascent viscosity" refers to either: the viscosity of the aqueous medium in which the staple fibers and air are dispersed by means of high-shear agitation to form the stable, viscous, air-fiber-water dispersion of this invention; or the viscosity of the aqueous media with which the viscous dispersion is diluted. The nascent viscosity, according to this invention, can be measured by a concentric cylinder-type viscometer, such as a Haake Viscometer, available from the Haake Instrument Co., Saddle Brook, N.J., or a Fann Viscometer, manufactured by the Fann Instrument Corp., Houston, Tex. The nascent viscosity is measured at about 25° C. using a sample of the aqueous media which can contain a dispersant and a thickener but not entrained, tiny air bubbles or suspended fibers.

In the viscous dispersion of the invention, about 1% to 50% by volume of air is dispersed as tiny bubbles. Preferably, the viscous dispersion contains about 1% to 10%, especially 2% to 4%, by volume of tiny air bubbles. It also is preferred that the nascent viscosity of the viscous dispersion be 10 to 50 cps., especially 15 to 30 cps., at a shear rate of 30.5 sec.$^{-1}$, when about 1% to 10% by volume of tiny air bubbles is dispersed in the viscous dispersion.

The individual fibers in the viscous dispersion formed by the process of this invention are distributed or dispersed uniformly throughout the dispersion. The tiny bubbles of entrained air also are distributed or dispersed uniformly throughout the viscous dispersion and between the individual, staple fibers. The fibers are separated from each other by the viscous, aqueous medium of the dispersion and by the tiny air bubbles, encapsulated in the thickened, aqueous medium. The quantity of thickener used and of tiny air bubbles provided by the high-shear agitation of this process should be sufficient to prevent any substantial contact between individual fibers and any substantial twisting or bending of individual fibers. The thixotropic thickener and tiny air bubbles thereby prevent knits, bundles and strings from forming when the air-fiber-water dispersion is further diluted and transported to the forming wire. However, the use of the dispersants and thickeners, at the levels used in this invention, does not unduly retard the drainage of water from the aqueous slurry in which the fibers are provided, just before they are wet-laid on the forming wire.

Preferably, the thixotropic thickener is added to the air-fiber-water mixture as a dilute aqueous solution, e.g., a 1% by weight aqueous solution. It also is preferred that the thixotropic thickener be added over a period of about ten to twenty minutes, particularly ten to fifteen minutes. If desired, addition of the thixotropic thickener can be prolonged over greater than about twenty minutes. However, this is generally wasteful of the energy required to continually agitate the air-fiber-water mixture. On the other hand, if desired, the thickener can be added in less than ten minutes. However, this generally increases by a substantial degree the risk of not fully and uniformly dispersing individual fibers throughout the resulting, viscous dispersion.

The resulting, stable, viscous, uniform, air-fiber-water dispersion of the two-step process of this invention has a nascent viscosity of 10 to 125 cps., preferably 10 to 50 cps., especially 15 to 30 cps., when measured at a shear rate of 30.5 sec.$^{-1}$. The viscous dispersion contains 1% to 50%, preferably 1% to 10%, especially 2% to 4% by volume of tiny air bubbles. The viscous dispersion also contains about 0.1% to 3% by weight of fibers.

As soon as it is formed in the pulper, the viscous dispersion can be utilized. Alternatively, the dispersion can be held in storage in the machine chest for a limited period, such as up to twelve hours. If held in storage, the dispersion should be agitated gently, preferably with a non-stapling agitator.

In the process of this invention, any conventional, non-stapling agitator can be utilized. The non-stapling agitator must be adapted so that the relatively long and thin, flexible fibers in the viscous dispersion of this invention do not accumulate or bend around the loading edge of the moving, agitator blades, thereby forming compacted fiber masses which can accumulate in the viscous dispersion.

Figure 2:
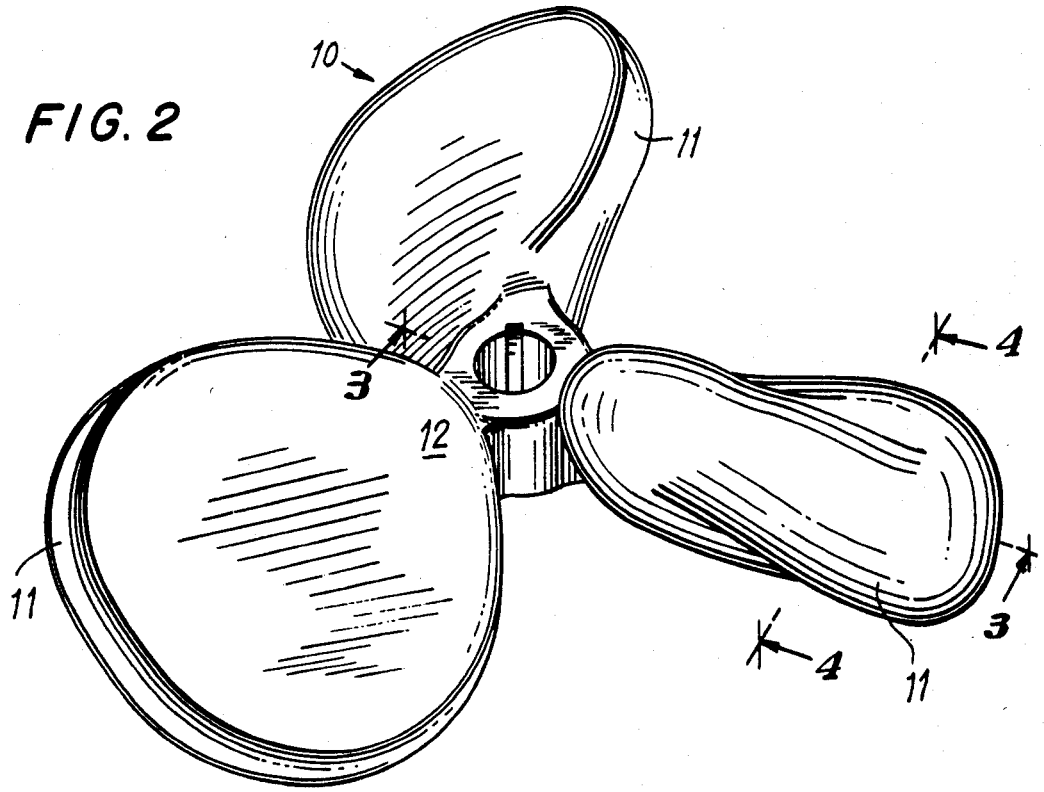
FIG. 2 is a perspective view of a non-stapling agitator of this invention.
Figure 3:
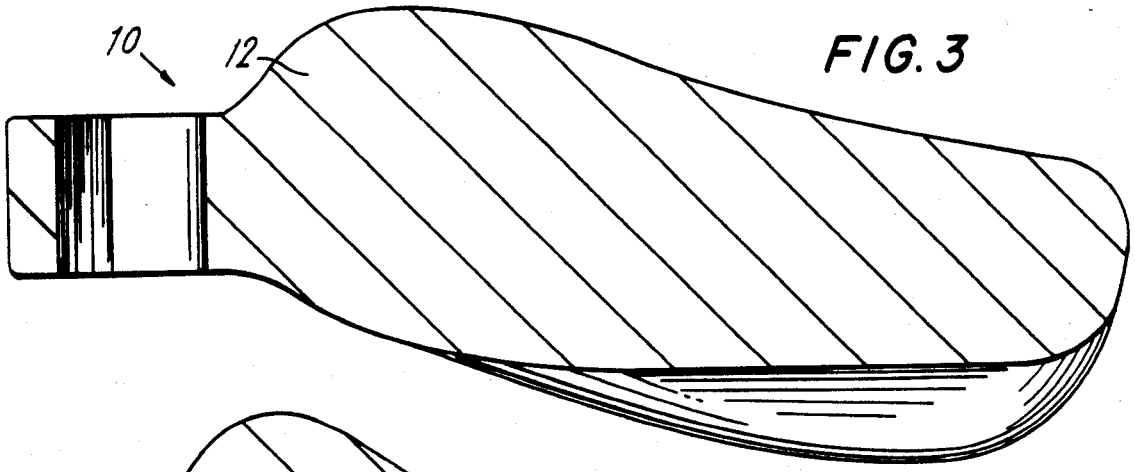
FIG. 3 is a sectional view taken along line 3—3 in FIG. 2.
Figure 4:
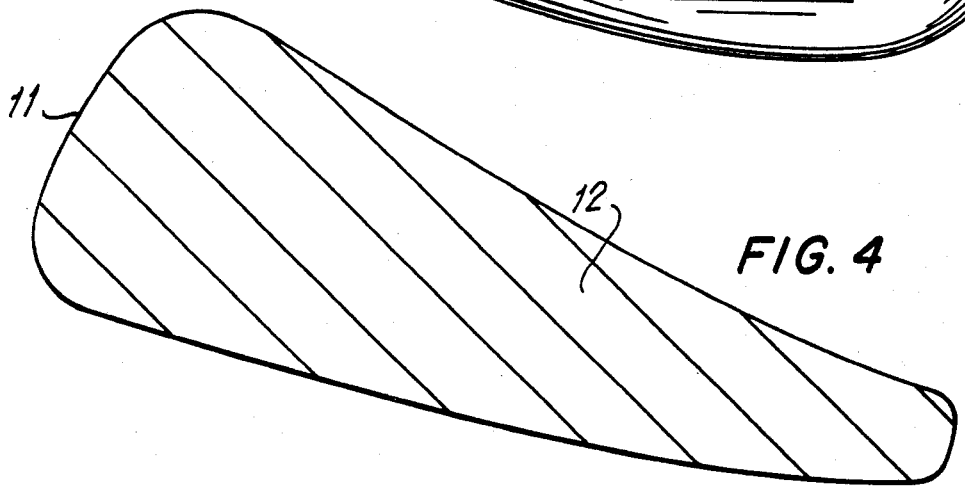
FIG. 4 is a sectional view taken along line 4—4 in FIG. 2, showing the thickened profile of each blade of the agitator.

In accordance with the process of this invention, the preferred, non-stapling agitator 10 is shown in FIGS. 2 to 4. Rounded, leading edges 11 are provided on each thickened, pitched blade 12 of the agitator 10. The rounded edges have a diameter at least equal to the length of the longest, staple fiber in the viscous dispersion. Preferably, the diameter of the rounded, leading edge of each blade is equal to about 1.5 times the length of the longest fiber in the viscous dispersion. As seen in FIGS. 2 to 4, the non-stapling agitator 10 has three blades 12 and the general configuration of a thickened marine propeller. However, in accordance with this invention, the non-stapling agitator can suitably have any number of blades, e.g., 2, 3 or 4, and may suitably have other thickened configurations, such as a thickened, "weedless" propeller configuration. However, in all of the non-stapling agitators of this invention, it is considered critical that the rounded, leading edge of each blade of the agitator have a diameter of at least the length of the longest fiber in the viscous dispersion.

Preferably, before the viscous dispersion is pumped from the pulper to the machine chest, the viscous dispersion undergoes a primary dilution step. In this primary dilution step, the viscous dispersion is uniformly mixed with and distributed throughout a viscous diluent, without undue entangling of the fibers.

In pumping the viscous dispersion from the pulper, it is preferred that a helical progressive cavitation pump be utilized. Such a pump is available under the trade name Moyno pump from Roberts & Meyers, Inc., Philadelphia, Pa. Use of such a pump assures that the pumping of the viscous dispersion from the pulper does not cause the fibers in the viscous dispersion to become entangled.

In carrying out the primary dilution step, the viscous dispersion preferably is pumped to an agitated, mixing tank containing a viscous, diluting medium. It is preferred that agitation of the contents of the mixing tank be provided by a non-stapling agitator. It also is preferred that the viscous dispersion be introduced into the agitated, mixing tank below the surface of the viscous, diluting medium. In this dilution step, the viscous, diluting medium is an aqueous solution which contains a thixotropic thickener. The viscous, dispersing medium also can contain a dispersant. Among the thixotropic thickeners and dispersants which can be utilized in the diluting medium are the thixotropic thickeners and dispersants utilized in the viscous dispersion of this invention. Preferably, the viscous, diluting medium in this step is a white water containing additional, thixotropic thickener. In accordance with this invention, the diluting medium for the primary dilution step has about the same nascent viscosity as the nascent viscosity of the viscous dispersion. This is necessary so that addition of the viscous dispersion to the diluting medium does not cause the fibers in the viscous dispersion to floccuate to form knits, bundles and strings. The diluting medium in this step also can contain entrained air bubbles.

In this primary dilution step, any conventional mixing tank arrangement can be utilized. It is preferred that a slant bottom mixing tank with a side entry impeller be utilized. It also is preferred that a non-stapling agitator of the type shown in FIGS. 2 to 4 be used.

Generally, in the resulting, agitated mixture of the viscous dispersion and the viscous, diluting medium, the concentration of entrained, tiny air bubbles is less than the concentration of entrained air in the viscous dispersion. However, where a viscous dispersion having about 1% to 10% by volume air is added to a viscous, diluting medium in accordance with this invention, it has been found that a level of air entrainment of about 1% to 10% by volume can be achieved in the resulting mixture merely by gently agitating the mixture in the mixing tank.

Instead of carrying out the primary dilution of the viscous dispersion in an agitated mixing tank, other methods can be utilized. For example, the viscous dispersion may be mixed with the viscous, diluting medium in an eductor. For such a dilution step, the preferred eductor is a Vanductor, manufactured by Bolton Emerson Corp., Lawrence, Mass. In carrying-out this dilution step in an eductor, the viscous dispersion preferably is introduced into the eductor through the annulus ring of the eductor while the viscous, diluting medium is introduced through the center feed of the eductor. Also, in this dilution step, the outlet of the center feed of the eductor preferably is just upstream of the vena contracta.

In carrying out the primary dilution of the viscous dispersion, from 2 to 5 volumes, preferably 3 volumes of the viscous, diluting medium are utilized per volume of the viscous dispersion. As a result, a once-diluted, viscous dispersion of air, fibers and water is obtained. The once-diluted, viscous dispersion contains about 0.03% to 1.0%, preferably about 0.5%, by weight fibers. However, the nascent viscosity of the once-diluted, viscous dispersion is about the same as the nascent viscosity of the viscous dispersion formed in the pulper.

The once-diluted, viscous dispersion or the viscous dispersion from the pulper, if no primary dilution step is carried out, then is pumped to the mahine chest. The machine chest utilized can be a conventional mixing tank, preferably having a slant bottom and a side entry impeller. It also is preferred that the machine chest have a non-stapling agitator, as described above, and that the viscous dispersion from the pulper or the once-diluted, viscous dispersion be added to the machine chest below the level of the viscous dispersion already in the machine chest.

After being held in the machine chest, the viscous dispersion, which is preferably a once-diluted, viscous dispersion, is diluted again. In this secondary dilution, the viscous dispersion of fibers is pumped from the machine chest, preferably utilizing a Moyno pump, and is mixed with a white water. In carrying out this secondary dilution, high-shear forces are applied to the once-diluted, viscous dispersion by the white water.

The white water utilized contains thickener and dispersant and has a nascent viscosity of about 5 to 30 cps., preferably about 10 to 15 cps., at a shear rate of 30.5 sec.$^{-1}$. The white water also contains about 1% to 10%, preferably about 2% to 4%, by volume of air. The air is entrained in the white water as tiny bubbles. Because of the tendency of the tiny air bubbles in the white water system to flow out of suspension, it is very important, in this process, to keep the white water in a constant state of agitation.

It is preferred that the mixing of the white water and the once-diluted, viscous dispersion from the machine chest be carried out in an eductor, such as a Vanductor. In this step, the once-diluted, viscous dispersion preferably is fed to the annulus ring of the eductor, and the white water preferably is fed to the center feed of the eductor. Also, it is preferred that the outlet of the center feed be just upstream of the vena contracta of the eductor. In this secondary dilution, one volume of the once-diluted, viscous dispersion is diluted by about 2 to 12 volumes, preferably about 7 volumes, of white water. As a result of mixing the once-diluted, viscous dispersion from the machine chest and the white water, while the white water applies high-shear forces to the viscous dispersion, the once-diluted, viscous dispersion is uniformly mixed with and distributed throughout the white water, without undue entangling of the fibers. A twice-diluted, visous, air, fiber and water dispersion results from this step, having a nascent viscosity of about 10 to 30 cps., preferably about 15 to 20 cps., at a shear rate of 30.5 sec.$^{-1}$, and an entrainment of tiny air bubbles of about 1% to 10%, preferably about 2% to 4%, by volume.

The high-shear mixing of the once-diluted, viscous dispersion of fibers from the machine chest with white water is considered a very important step in the process of this invention. In this high-shear mixing, the dilution of the viscous, air-fiber-water dispersion from the machine chest occurs without entangling of the fibers. It is believed that the presence of the tiny air bubbles in both the once-diluted, viscous dispersion and in the white water prevents undue contacting of fibers from occurring, thereby minimizing the risk of forming knits, bundles and strings of the fibers.

After the secondary dilution with white water, one or more additional dilutions of the fiber containing, twice-diluted, viscous dispersion can be carried out. The tertiary and, if desired, subsequent, dilution steps also are carried out with the white water. The tertiary and subsequent dilutions can involve diluting one volume of the twice-diluted, fiber-containing, viscous dispersion with 1 to 20 volumes of diluting white water, preferably about 10 volumes of diluting white water. The tertiary and subsequent dilutions can be carried out in an eductor or other mixer in which the white water applies high-shear forces to the fiber-containing, diluted dispersions. However, this is not necessary. The viscous, air-fiber-water dispersion, after the secondary dilution, can be suitably diluted further in conventional, headbox approach piping.

After the tertiary and subsequent dilutions of the fiber-water dispersions, a uniform, dilute dispersion is obtained having a fiber consistency of about 0.001% to 0.1%, preferably 0.001% to 0.010%, particularly 0.005% to 0.010%, by weight. The dilute dispersion has a nascent viscosity of about 5 to 30 cps., preferably about 10 to 15 cps., at a shear rate of 30.5 sec.$^{-1}$, and an entrainment of tiny air bubbles of about 1% to 10%, preferably about 2% to 4%, by volume. The dilute dispersion can be conducted to and wet-laid on conventional, paper making equipment to form a non-woven fabric of the process of this invention. For example, a non-woven fabric of this process, having a basis weight of about 15 to 150 g/m$^2$, preferably about 25 to 100 g/m$^2$, can be suitably obtained by wet-laying the dilute dispersion using the headbox, inclined forming wire and suction box arrangement disclosed in U.S. Pat. No. 3,764,465.

Of course, instead of preparing the original, viscous, air-fiber-water dispersion of this invention with fresh water, white water, which has already been modified with dispersant and thickener materials, also can be used. If this is done, the amount of such agents added to the pulper in the two steps of this process to form the viscous, air-fiber-water dispersion should be adjusted, depending on the types and characteristics of the fibers in the furnish.

The whole process of forming and maintaining the viscous dispersions of air and fibers is aided by using water having a temperature of above 70° F. (21.1° C.). If temperatures cooler than about 70° F. are used, the formation and maintenance of the dispersions of air and fibers have been found to take longer and to be more difficult. The precise pH of the water is not critical, and a pH of above 6, preferably about 7, is suitable.

It has been noted that the fabric web produced by the process of this invention has an enhanced, initial, wet web strength. It is believed that the length of the staple fibers used and their uniform, random distribution in the fabric web is primarily responsible for the enhanced wet web strength. At the levels used in this process, the dispersants and thickeners do not, to a substantial degree, act as binders or adhesives for the fibers in the finished, non-woven fabric, although these materials may contribute somewhat to the strength of the wet, fabric web as it comes off of the forming wire and is transferred to another station for further treatment. Naturally, if the fibers utilized have large, flat surface areas for contacting other fibers, they would be held together even more tightly than with round or non-flat surface fibers. Nevertheless, the process according to this invention works well with both round and other, non-flat surface fibers.

Because the non-woven fabric produced by this process is formed in a substantially binder free condition, it is tender and relatively easy to pull apart. Accordingly, a primary binder material in the form of a high solids latex foam preferably is applied to the web as a primary binder after the web is removed from the forming wire and before it is fully dried. The precise characteristics of the binder are chosen according to the desired characteristics of the finished fabric. In some instances, it also may be desirable to further treat the finished material with additional binders to achieve the desired characteristics.

Preferably, the primary binder is applied throughout the fabric web in the form of a high solids content latex (i.e., at least 6% solids) foam. A foam density in the range of between about 25 to 150 grams per liter appears to be satisfactory for the binder and it can be applied using known equipment such as the foam distributor header disclosed in U.S. Pat. No. 3,722,469.

The precise latex formulation used on any given fabric depends principally on the drape, hand and other desired characteristics of the final material. Some formulations are softer than others and some tend to make a stiffer fabric. The general characteristics of foamable latexes available for non-wovens are known and can be easily chosen with the desired characteristics. If desired, after the non-woven fabric is dried, the fabric can be subjected to additional bonding or other treatments to further modify its characteristics.

The non-woven fabric produced by the process of this invention, which contains at least about 10% by weight of relatively long and thin, flexible, synthetic fibers, having a length to diameter ratio of 400 to 3000, is considered a commercially superior, non-woven fabric.

In this fabric, the fibers have a substantially uniform, random distribution. This is a direct result of the uniform, random distribution of the fibers in the viscous dispersion and in the diluted, viscous dispersions of the process of this invention. Because of the uniform, random fiber distribution in the non-woven fabric, the fabric produced by this process has a microvariation in basis weight of not more than about 10% and a macrovariation in basis weight of not more than about 5%. Also for this reason, the non-woven fabric has a tensile strength which is substantially the same in all directions, i.e., machine direction and cross direction. In addition, the non-woven fabric is substantially free of knits, bundles and strings of fibers. Further, because of the relatively long and thin, flexible fibers utilized in the non-woven fabric, the fabric has a greater tensile strength, a softer hand and a better drape than fabrics made from fibers of comparable weight and shorter length.

The non-woven fabric of this process, which contains at least 50%, particularly 90% to 100%, by weight of relatively long and thin, flexible, synthetic, hydrophobic fibers, having a length to diameter ratio of about 1000 to 3000 and a length of at least ½ inch, is considered unique. This particular fabric has the aforementioned, substantially uniform, random, fiber distribution, microvariation in basis weight of not more than about 10%, macrovariation in basis weight of not more than about 5%, tensile strength which is substantially the same in all directions, and substantial freedom from knits, bundles and strings. In addition, because of the longer length and larger, length to diameter ratio of the relatively long and thin, flexible fibers utilized and because of the amount of such long and thin, flexible fibers in this unique, non-woven fabric, the fabric has an even greater tensile strength, softer hand and better drape than fabrics made from fibers of comparable weights but of shorter lengths and smaller, length to diameter ratios.

As used throughout this application, the "microvariation in basis weight" is the average, arithmetic variation in weight of an equal number (at least five) of ½ inch diameter samples taken from regions of apparently (visually) high density and from regions of apparently (visually) low density of a non-woven fabric. The regions of apparently high density can appear as islands of high opacity, surrounded by a field of otherwise uniform, lower opacity. In such a case, the regions of apparently low density are the surrounding field of lower opacity. Alternatively, the regions of apparently high density can appear as a field of uniform opacity containing islands of lower opacity. In such a case, the islands of apparently lower opacity are the regions of apparently low density. The overall, visual effect of a condition, in a non-woven fabric, of regions of apparently high density and apparently low density is a blotchy or cloudy appearing, non-woven fabric.

As used throughout this application, the "macrovariation in basis weight" is the coefficient of variation in weight of a number (at least five) of 1 inch diameter samples taken at random from a fabric sample having a dimension of about 1 yard by 2 yards.

The examples which follow further illustrate the process of this invention.

EXAMPLE 1

2280 gallons of white water containing Triton X-114 alkylaryl polyether alcohol type dispersant (about 0.001% by wt.) and Separan AP-30 polyacrylamide thickener (about 0.02% by wt.) are added to a hydropulper. 1800 ml. of 2N-sulfuric are added to the white water in the pulper to aid in the removal of the hydrophobic coating on the fibers to be added to the pulper. Then, 100 ml. of Triton X-114 alkylaryl polyether alcohol type dispersant is added to the pulper, and the high-shear agitation of the pulper is started. 300 lb. of 1.5 denier by ¾ inch polyester fibers are added to the agitated, water-dispersant mixture. Immediately after adding the fibers, the addition to the pulper is begun of 120 gallons of a 1% by weight, aqueous solution of Separan AP-30 polyacrylamide thickener. Complete addition of the 120 gallons taken about 15 minutes. A stable, viscous, uniform dispersion of air (about 4% by volume), fibers and water is formed.

At the same time, in a mixing tank, equipped with a non-stapling agitator, 4000 gallons of water are mixed with 220 gallons of a 1% by weight, aqueous, Separan AP-30 polyacrylamide thickener, and the aqueous mixture in the mixing tank is thoroughly agitated to form a viscous, diluting medium.

The viscous, air-fiber-water dispersion in the pulper is pumped, using a Moyno pump, to the mixing tank where it is mixed with the viscous, diluting medium. A mixture of 500 gallons of the white water and 20 gallons of a 1% by weight, aqueous solution of Separan AP-30 polyacrylamide thickener then is added to the mixture in the mixing tank. The resulting, viscous mixture in the mixing tank then is dropped to the machine chest, equipped with a non-stapling agitator.

The viscous mixture in the machine chest then is pumped, using a Moyno pump, to the annulus ring of a Vanductor, where it is diluted with seven volumes of the white water, fed to the center feed of the Vanductor. The diluted mixture then is diluted further with ten volumes of the white water and is applied to a forming wire of 60 to 70 mesh. A non-woven, polyester web, having essentially no knits, bundles or strings is formed on the forming wire.

EXAMPLE 2

Batches of a viscous, air (about 4% by volume)-fiber-water dispersion are formed by the steps of: high-shear agitating in a pulper a mixture of 160 gallons of water and 1 gallon of an aqueous, 25% by weight solution of Collacral DS-2017 polyacrylate dispersant; adding 10 lbs. of 1.5 denier by $\frac{3}{4}$ inch polyester fibers to the agitated mixture in the pulper; high-shear agitating the fiber containing mixture for 10 minutes; and then, slowly adding, over a 10 minute period, 40 gallons of a 1% by weight, aqueous, Separan AP-30 polyacrylamide thickener solution.

Four batches of the viscous dispersion from the pulper are mixed in the machine chest, equipped with a non-stapling agitator. Then, utilizing the procedure of Example 1, the contents of the mixing chest are: first diluted in a Vanductor, with five volumes of a compatible, white water; diluted again with four volumes of a compatible, white water; and wet-laid on a forming wire to form a non-woven, polyester web, having essentially no knits, bundles or strings.

EXAMPLE 3

Batches of a viscous, air (about 40% by volume)-fiber-water dispersion are formed by the steps of: high-shear agitating in a pulper a mixture of water, 0.6% by volume of an aqueous, 25% by weight solution of Collacral DS-2017 polyacrylate dispersant, and 2.5% by volume of an aqueous, 28% by weight solution of Acrysol ASE-60 polyacrylic acid dispersant (Available from Rohm and Haas Corp., Philadelphia, Pa.); adding 10 lbs. of 1.5 denier by $\frac{3}{4}$ inch polyester fibers to the agitated mixture in the pulper; high-shear agitating the fiber containing mixture for 10 minutes; neutralizing (to a pH of 7) the agitated mixture with 1-N sodium hydroxide; and then, slowly adding, over a 10 minute period, 0.6% by volume of an aqueous, 10% by weight solution of Acrysol HV-1 sodium polyacrylate thickener (Available from Rohm and Haas Corp., Philadelphia, Pa.).

The batches of the viscous dispersion from the pulper are mixed in a mixing tank (equipped with a non-stapling agitator) with three volumes of a compatible, viscous, diluting medium to form a diluted, viscous dispersion containing about 10% by volume of entrained air. The diluted, viscous mixture is then dropped to the machine chest (equipped with a non-stapling agitator), diluted, and wet-laid on a forming wire, in accordance with the procedure of Example 2, to form a non-woven, polyester web, substantially free of knits, bundles and strings.

EXAMPLE 4

A non-woven, 100% polyester fabric, formed by the process of Example 1 from 1.5 denier by $\frac{3}{4}$ inch polyester fibers (length to diameter ratio of 1524), treated with a foamed, acrylic latex, primary binder in an amount of about 20% by weight of the fabric, and having a basis weight of about 50 g/m$^2$, is tested for microvariation and macrovariation in basis weight and for distribution of void sizes.

The microvariation in basis weight of the fabric is determined by cutting and weighing five, $\frac{1}{2}$ inch diameter samples from regions of apparently high density and five, $\frac{1}{2}$ inch diameter samples from regions of apparently low density. All the samples are cut from a 1 square foot, randomly selected sample of the fabric. By determining the average, arithmetic variation of the weights of the ten samples, the microvariation in the basis weight is found to be 10%.

The macrovariation in basis weight of the fabric is determined by randomly taking three, 1 square foot samples from a 1 yard by 2 yard sample, and then, from each 1 square foot sample, cutting and weighing thirty-one, 1 inch diameter samples, taken in a scatter pattern. By determining the coefficient of variation of the weights of the ninety-three, 1 inch diameter samples, the macrovariation in basis weight is found to be 5%.

A randomly selected portion of the surface of the fabric is electronically scanned, and the diameter of voids in the fabric of at least 43 micrometers is measured. The results are as follows:

| Void diameter (mm) | Frequency distribution (%) |
|---|---|
| 0–0.09 | 15.6 |
| 0.09–0.17 | 51.2 |
| 0.17–0.26 | 25.9 |
| 0.26–0.34 | 5.3 |
| 0.34–0.43 | 1.4 |
| 0.43–0.52 | 0.4 |
| 0.52–0.60 | 0.2 |

These results show that 90% of the voids in the fabric are 0.26 mm or less in diameter.

It is thought that the invention and many of its attendant advantages will be understood from the foregoing description and examples, and it will be apparent that various changes may be made in the steps of the process described and their order of accomplishment without departing from the spirit and scope of the invention or sacrificing all of its material advantages, the process hereinbefore described and exemplified being merely preferred embodiments thereof.

We claim:

1. A wet-laid non-woven fabric containing a binder which comprises at least 50% by weight of synthetic, hydrophobic fibers, having a length to diameter ratio of about 1000 to 3000 and a length of at least $\frac{1}{2}$ inch; which has a microvariation in basis weight of not more than about 10% and a macrovariation in basis weight of not more than about 5%; and which is essentially free of knits, bundles and strings.

2. The non-woven fabric of claim 1 which comprises 90% to 100% by weight of the synthetic, hydrophobic fibers.

3. The non-woven fabric of claim 2 which comprises 100% by weight of the synthetic, hydrophobic fibers, having a length to diameter ratio of about 1500.

4. The non-woven fabric of claim 3 wherein the synthetic, hydrophobic fibers are 1.5 denier by $\frac{3}{4}$ inch polyester fibers.

5. The non-woven fabric of claim 1 wherein the synthetic, hydrophobic fibers have a length to diameter ratio of about 1500 or more.

6. The non-woven fabric of claim 5 wherein the synthetic, hydrophobic fibers have a length to diameter ratio of about 1500 to 2000.

7. The non-woven fabric of claim 6 wherein the synthetic, hydrophobic fibers are 1.5 denier by $\frac{3}{4}$ inch polyester fibers.

8. The non-woven fabric of claim 1 having a basis weight of about 100 g/m$^2$ or less.

9. The non-woven fabric of claim 8 having a basis weight of about 15 g/m$^2$ or greater.

10. The non-woven fabric of claim 8 having a basis weight of about 25 to 100 g/m$^2$.

11. The non-woven fabric of claim 10 wherein the synthetic, hydrophobic fibers have a length to diameter ratio of about 1500 or more.

* * * * *